US009089882B2

(12) United States Patent
Boltus

(10) Patent No.: US 9,089,882 B2
(45) Date of Patent: Jul. 28, 2015

(54) SELF-LIMITING VACUUM NOZZLE AND METHODS FOR USING SAME

(76) Inventor: Gregory Boltus, Baldwinsville, NY (US)

( * ) Notice: Subject to any disclaimer, the term of this patent is extended or adjusted under 35 U.S.C. 154(b) by 427 days.

(21) Appl. No.: 13/485,173

(22) Filed: May 31, 2012

(65) Prior Publication Data

US 2013/0098405 A1 Apr. 25, 2013

Related U.S. Application Data

(60) Provisional application No. 61/550,139, filed on Oct. 21, 2011.

(51) Int. Cl.
*B08B 5/04* (2006.01)
*A47L 9/02* (2006.01)

(52) U.S. Cl.
CPC .... *B08B 5/04* (2013.01); *A47L 9/02* (2013.01)

(58) Field of Classification Search
CPC ..... A47L 9/02; A47L 5/28; A47L 9/242; A47L 9/0613; A47L 7/0009; A47L 9/06; B08B 5/04
USPC ..... 15/415.1, 421, 322, 340.1, 344, 375; 215/262
See application file for complete search history.

(56) References Cited

U.S. PATENT DOCUMENTS 5,005,470 A * 4/1991 Denker ..... 454/63
5,143,629 A * 9/1992 Lint ..... 210/776
5,356,115 A * 10/1994 Helmick ..... 251/294
2002/0189047 A1* 12/2002 Nakabayashi ..... 15/344
2004/0068824 A1* 4/2004 Gardner ..... 15/322
2006/0143853 A1* 7/2006 Agerlid et al. ..... 15/353
2009/0031932 A1 2/2009 Mori et al.

FOREIGN PATENT DOCUMENTS

CN 101368756 A 2/2009
EP 2181888 A1 5/2010
JP 2005056704 A 3/2005
JP 2006346520 A 12/2006
JP 2007012461 A 1/2007
JP 2008055258 A 3/2008

* cited by examiner

*Primary Examiner* — Robert Scruggs
(74) *Attorney, Agent, or Firm* — Harris Beach PLLC

(57) ABSTRACT

A self-limiting vacuum (SLV) nozzle is provided for collecting or removing combustible dust. The nozzle comprises a nozzle body comprising a nozzle inlet port, a nozzle unloader port, and a suction port; a suction tube assembly operably connected to the nozzle inlet port; a material deflector for directing vacuumed material from the suction tube assembly into the suction port; and an unloader hood installed in the unloader port. Discs can be installed in the unloader or suction port to control collection of combustible dust by the nozzle so that the concentration of dust collected within the hose stays below the minimum explosive concentration (MEC). The nozzle is operably connected to a vacuum source. Systems and methods for collecting combustible dust using the nozzle and a vacuum system are provided. Operation of the nozzle regulates the MEC of the combustible dust that is collected in the vacuum system.

19 Claims, 9 Drawing Sheets

SELF-LIMITING VACUUM NOZZLE AND METHODS FOR USING SAME

CROSS-REFERENCE TO RELATED APPLICATIONS

This application claims priority to and the benefit of co-pending U.S. provisional patent application Ser. No. 61/550,139, entitled Self-Limiting Vacuum Nozzle and Methods for Using Same, filed Oct. 21, 2011, which is incorporated herein by reference in its entirety.

STATEMENT REGARDING FEDERALLY SPONSORED RESEARCH OR DEVELOPMENT

Not applicable

1. Technical Field

The present invention relates to devices and methods for cleaning fine, dry, particulate matter such as combustible dust by use of a vacuum system incorporating a self-limiting vacuum nozzle.

2. Background of the Invention

The removal of combustible dusts or powders from industrial structures has been an important service for many years. The removal of combustible dust is known in the art to be dangerous, as combustible dusts have a Minimum Explosive Concentration (MEC) which cannot be exceeded within the equipment being used to remove the dust without the risk of explosion.

Combustible dusts can include, but are not limited to, coal dust, grain and flour dust, confectioner sugar dust, resin or polymer dust (e.g., phenol formaldehyde resin dust, polyethylene dust) and combustible metals such as alkali metals, aluminum, magnesium, niobium, tantalum, titanium, and zirconium (see NFPA® 484: Standard for Combustible Metals, 2009 edition, NFPA, Quincy, Mass.; also referred to herein as NFPA 484)). For example, aluminum can spark under certain circumstances, such as upon impact with rusted iron or steel, where a minor thermite reaction can be initiated.

Any material that will burn in air in a solid form can be explosive when in a finely divided form. Deadly fires explosions have occurred recently in a foundry (resin dust), a pharmaceutical plant (polymer dust), manufacturing plant (insulation dust), auto wheel plant (metal dust) (see U.S. Department of Labor, Occupational Safety and Health Administration, Directorate of Standards and Guidance, Office of Safety Systems, "Combustible Dust in Industry: Preventing and Mitigating the Effects of Fire and Explosions", Safety and Health Information Bulletin, SHIB Jul. 31, 2005. There are thus significant hazards to human life and health associated with combustible dusts and work practices. Removal equipment and methods that reduce the potential for a combustible dust explosion are needed.

Citation or identification of any reference in Section 2, or in any other section of this application, shall not be considered an admission that such reference is available as prior art to the present invention.

3. SUMMARY OF THE INVENTION

The invention provides a self-limiting vacuum (SLV) nozzle for the removal of combustible dust and systems and methods for using same.

One embodiment of the invention provides a self-limiting vacuum (SLV) nozzle for controlling the rate at which combustible dust is ingested into a vacuum system comprising a nozzle body further comprising an inlet port, an unloader port having a first internal cross-sectional area, and a suction port adapted for coupling to a vacuum hose; a suction tube assembly operably connected to the inlet port; an unloader disc adjacent to the unloader port, said unloader disc defining an opening of selectable size, said opening having a second cross-sectional area less than the first cross-sectional area of the unloader port; whereby the size of the opening in the unloader disc is selected to control the rate at which the combustible dust is ingested by a vacuum system to maintain the concentration of combustible dust within the vacuum hose at a level below the minimum explosive concentration of the combustible dust.

In another embodiment the SLV further comprises a material deflector for directing vacuumed material from the suction tube assembly into the suction port.

In another embodiment of the SLV nozzle, the suction tube assembly includes suction tube assembly unloader ports. In another embodiment of the SLV nozzle, the suction tube assembly includes a positionable sleeve operatively coupled to the sleeve assembly to selectively cover one or more of the suction tube assembly unloader ports. In another embodiment of the SLV nozzle, the suction tube assembly further comprises a flow reducing tip comprising a cap and a conduit extending through said cap.

In another embodiment, SLV nozzle further comprises a suction disc defining an opening, said suction disc positioned adjacent to the suction port. In another embodiment, the SLV nozzle further incorporates a screen adjacent to the suction tube assembly that restricts the inadvertent ingestion of carbon steel hardware that might otherwise cause a spark in the vacuum system.

Another embodiment of the invention provides a vacuum system for removing combustible dust comprising a vacuum source; a self-limiting nozzle operatively connected to the vacuum source by a vacuum hose, the self-limiting nozzle comprising a nozzle body having a nozzle inlet port, a nozzle unloader port, and a suction port coupled to the vacuum hose; a suction tube assembly operably connected to the nozzle inlet port; the nozzle body adapted to receive a nozzle unloader disc adjacent to the nozzle unloader port, said nozzle unloader disc defining an opening of a selectable size, whereby the size of the opening in the unloader disc is selected to control the rate at which the combustible dust is ingested by the vacuum system to maintain the concentration of combustible dust within the vacuum hose at a level below the minimum explosive concentration of the combustible dust.

In another embodiment of the vacuum system, the SLV nozzle further comprises a material deflector for directing vacuumed material from the suction tube assembly into the suction port.

In another embodiment of the vacuum system, the suction tube assembly comprises suction tube assembly unloader ports. In another embodiment, the suction tube assembly comprises a positionable sleeve operatively coupled to the sleeve assembly to selectively cover at least one of the suction tube assembly unloader ports.

In the embodiments of the vacuum system, the size of the opening in the unloader disc is selectable by either inserting one of a plurality of unloader discs defining openings of differing cross-sectional areas, or a variable aperture mechanism. In another embodiment of the vacuum system, the vacuum hose includes a conductive element that is bonded to ground.

Another embodiment of the invention provides a method for collecting combustible dust comprising the steps of: determining the minimum explosive concentration of a combustible dust to be collected; providing a self-limiting nozzle (SLV) comprising a nozzle body having a nozzle inlet port, a nozzle unloader port, a suction port, and a nozzle unloader disc adjacent to the nozzle unloader port, said nozzle unloader disc defining an opening of a selectable size; operatively connecting the self-limiting nozzle to a vacuum hose, said vacuum hose being operatively connected to a vacuum source having a known suction force and air flow rate; determining a desired rate of ingestion of the combustible dust that maintains the concentration of the combustible dust within the vacuum hose at a level below the minimum explosive concentration of said dust; selecting the size of the opening of the nozzle unloader disc, given the suction force and flow rate of the vacuum source, that limits the rate of ingestion of combustible dust to maintain the concentration of dust below the minimum explosive concentration of said dust; and collecting by vacuum combustible dust using the self-limiting nozzle.

In another embodiment of the invention, the method further includes the step of controlling the rate of ingestion of combustible dust through the suction port by inserting a suction disc adjacent to the suction port. In another embodiment, the step of controlling the rate of ingestion of combustible dust is enhanced by providing the suction tube assembly unloader ports in the suction tube assembly. In another embodiment of the invention, the method further comprises the step of providing a vacuum hose that includes a conductive element which is bonded to ground. In another embodiment, the vacuum source is a truck-mounted, high flow rate vacuum source.

4. BRIEF DESCRIPTION OF THE DRAWINGS

The present invention is described herein with reference to the accompanying drawings, in which similar reference characters denote similar elements throughout the several views. It is to be understood that in some instances, various aspects of the invention may be shown exaggerated or enlarged to facilitate an understanding of the invention.

FIG. 1 shows one embodiment of the SLV nozzle (also referred to herein as a "SLV nozzle assembly" or "SLV nozzle body") being used by an operator to pick up a pile of fine dry particulate matter. The SLV nozzle 10 is operably connected to a vacuum source via a hose or tube 200. In this embodiment, the vacuum source is a truck mounted industrial vacuum system presently manufactured and sold by Guzzler Manufacturing, Inc., of Streator, Ill., commonly referred to as a "Guzzler." In this embodiment, the suction disc 160 is positioned within the inlet port 40. The unloader disc 100 is positioned within the unloader port 20 (also referred to herein as "SLV nozzle port for installing unloader"). The unloader 50 is positioned or fastened at the distal end of unloader port 20. The suction tube assembly 60 and suction tube assembly unloader ports 68 are indicated. In this embodiment, a vacuum gauge 47 is installed at an auxiliary or optional inlet port 45 for, e.g., a vacuum gauge, inert gas or water. The vacuum gauge can be used to monitor air flow in the SLV nozzle.

FIG. 2 shows another embodiment of the SLV nozzle 10. Suction tube assembly 60 with plurality of unloader ports 68. Material deflector 67. Optional sleeve 69 for the suction tube assembly unloader port(s) slides on the suction tube assembly 68 and is used to regulate strength of suction in the suction tube assembly. The suction tube unloader ports 68 and the optional sleeve 69 in this embodiment of the suction tube assembly regulate or decrease the pull of the vacuum. Suction disc 160 positioned within the inlet port 40. Unloader disc 100 positioned within the unloader port 20. Vacuum gauge 47 installed at inlet port 45 to monitor air flow in the SLV nozzle. The unloader 50 is positioned or fastened at the distal end of unloader port 20. In this embodiment, the distal end of the unloader 50 is a 90 degree elbow. Hose or tube 200 to vacuum source.

FIG. 3 shows interior view of SLV nozzle 10 from suction port 30, the port from the SLV nozzle to the vacuum system or vacuum source. Unloader port 20 connecting to an embodiment of the unloader 50 that is straight. Inlet port 40 connecting to suction tube assembly 60. Insertion flange 42 on inlet port 40 for suction disc 160. Material deflector or deflection elbow 67 for suction tube assembly 60. Suction tube assembly body 61. Insertion flange 62 for connecting suction tube assembly 60 to adapter 70. Insertion flange 72 for inserting suction tube assembly onto adapter 70. Fasteners 300.

Figure 6:
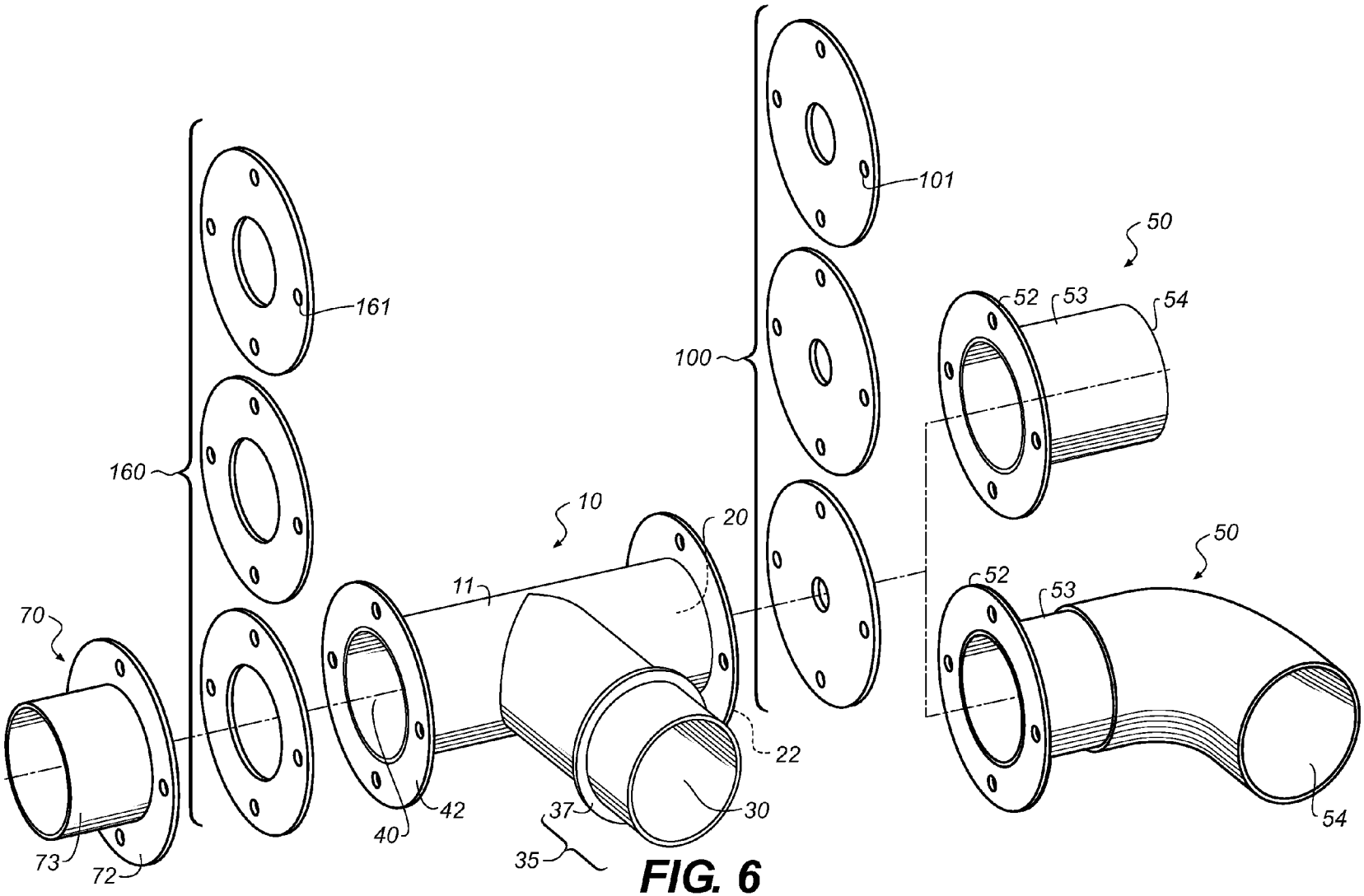

FIG. 6 shows one embodiment of an SLV nozzle 10. SLV nozzle body 11. SLV nozzle port 20 for installing unloader 50. Flange 22 for connecting (or mating) port 20 to unloader 50. Suction port 30 from SLV nozzle 10 to vacuum system or vacuum source. Connection section 35 of port 30 from SLV nozzle 10 to vacuum system or vacuum source. Flange 37 on connection section 35 for connecting hose 200 to SLV nozzle 10. Unloader 50 in straight or 90 degree elbow configurations. Flange 52 for connecting (or mating) unloader 50 to SLV nozzle port 20 for installing unloader. Unloader body 53. Unloader distal opening 54. Adapter 70 between SLV nozzle 10 and suction tube assembly 60. Insertion flange 72 for inserting suction tube assembly onto adapter 70. Connection section 73 of adapter 70. The connection section is preferably straight, as in this embodiment. SLV nozzle unloader disc 100. Through holes in unloader disc 101 for aligning and/or fastening to corresponding areas in flange 22 and/or 52. Any suitable fastener (e.g., screw) 300 can be used. SLV nozzle suction disc 160. Through holes in suction disc 161 for aligning and/or fastening to corresponding areas in flange 42 and/or 72. Any suitable fastener (e.g., screw) 300 can be used.

Figure 7:
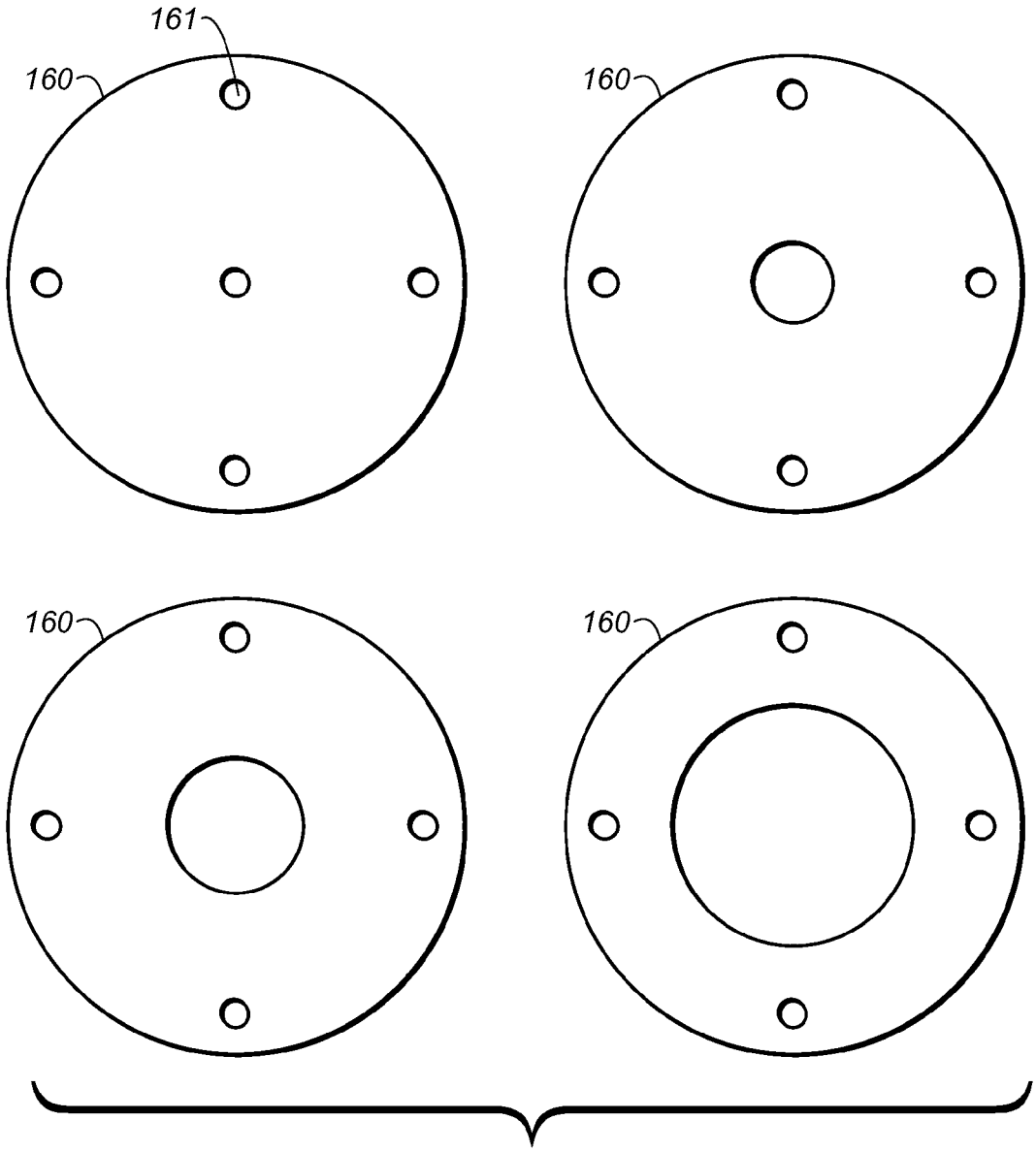

FIG. 7 illustrates four embodiments of SLV nozzle suction discs 160 (or unloader discs 100; in certain embodiments, they can be used interchangeably) with variable openings that can range, for example from 10%-70% of the total area of the cross-section of the suction and unloader sections of the SLV nozzle. In certain embodiments, either face of a disc can face the interior of the SLV nozzle. Through holes in the disc 161 for aligning and/or fastening to corresponding areas in flange 42 and/or 72. Any suitable fastener (e.g., screw) can be used.

Figure 8:
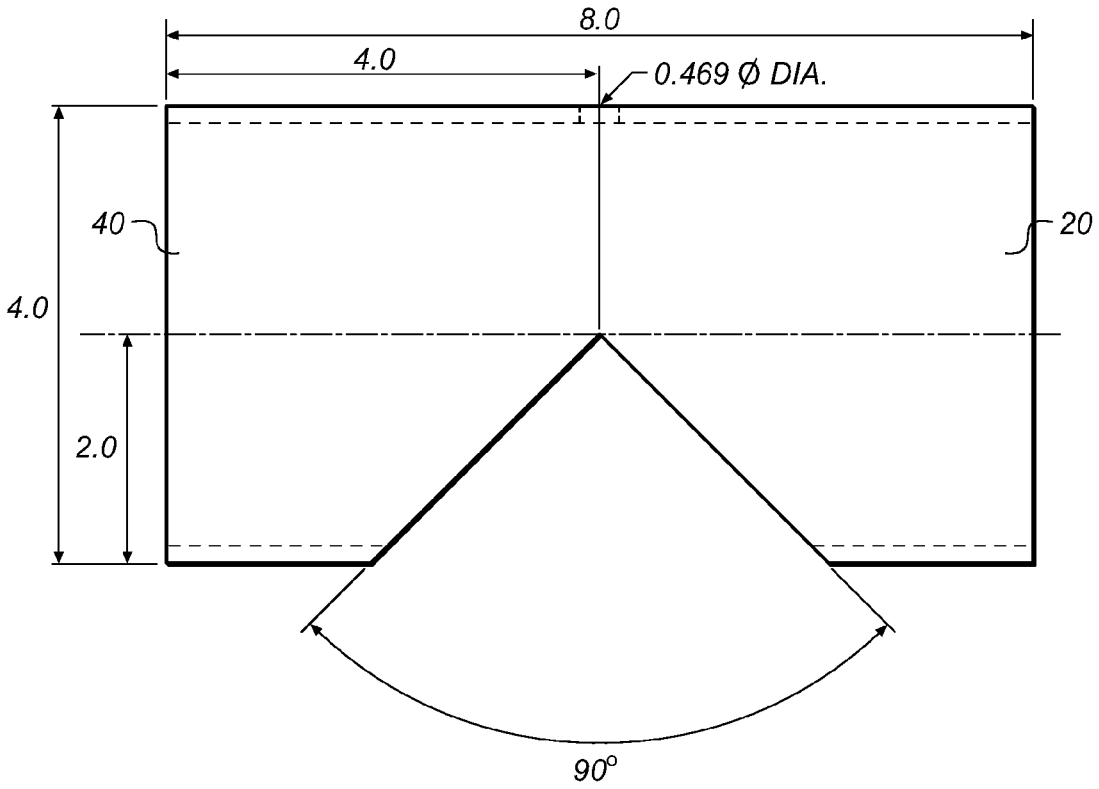

FIG. 8 shows side view of one embodiment of the inlet port 40 and unloader port 20 of the SLV nozzle body with exemplary dimensions (in inches) indicated.

Figure 9:
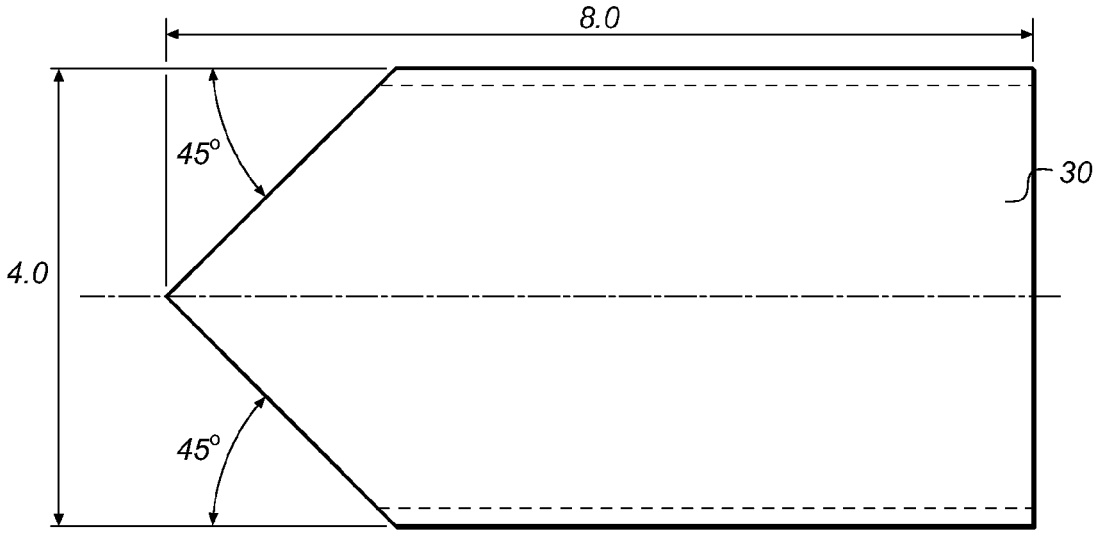

FIG. 9 shows side view of one embodiment of the SLV nozzle port 30 to vacuum source with exemplary dimensions (in inches) indicated.

Figure 10:
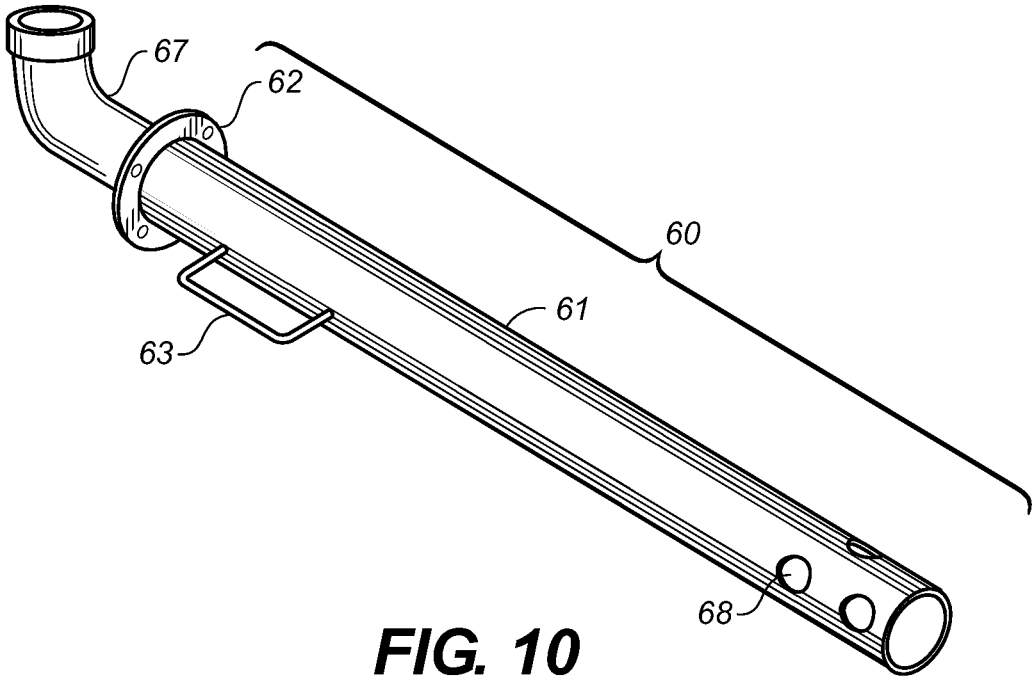

FIG. 10 shows suction tube assembly 60. This embodiment has a flat distal end for vacuuming Body 61. Insertion flange 62 for connecting suction tube assembly 60 to adapter 70. Optional handle 63 for directing position of suction tube assembly 60. Material deflector or deflection elbow 67 for suction tube assembly 60. Suction tube assembly unloader port 6

Figure 11:
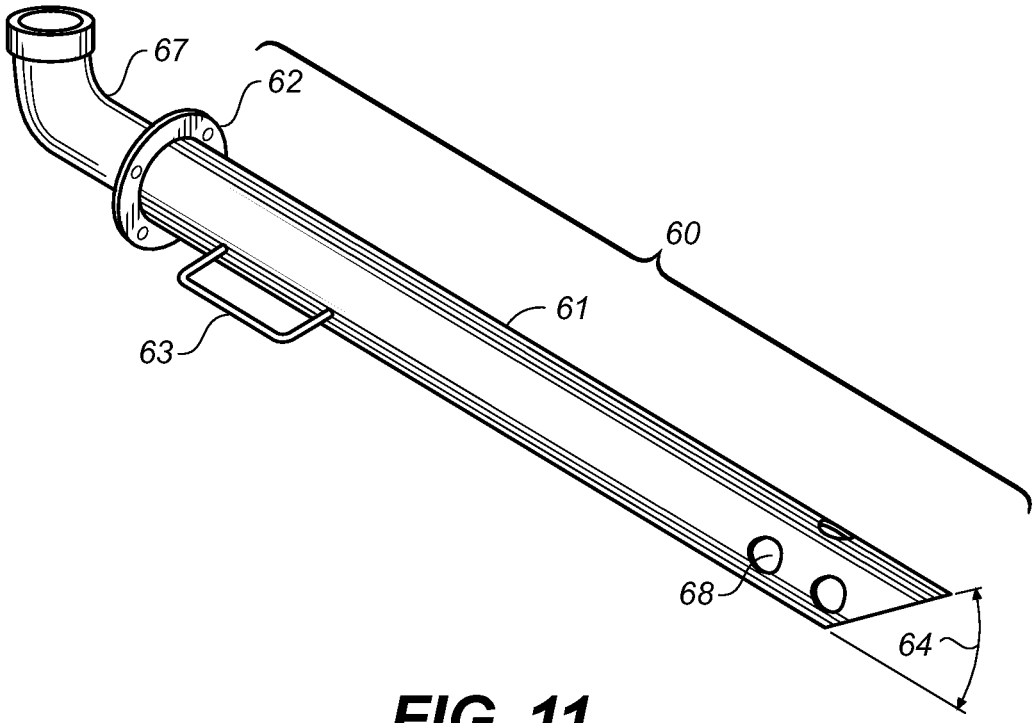

FIG. 11 shows another embodiment of the suction tube assembly 60. This embodiment has an angled distal end for vacuuming. Body of suction tube assembly 61. Insertion flange 62 for connecting suction tube assembly 60 to adapter 70. Optional handle 63 for directing position of suction tube assembly 60. Exemplary angle 64 for angled tip of suction tube assembly 60. Material deflector or deflection elbow 67 for suction tube assembly 60. Suction tube assembly unloader port 68.

5. DETAILED DESCRIPTION OF THE INVENTION

The present invention provides a self-limiting vacuum (SLV) nozzle for the removal of combustible dust and systems and methods for using same.

For clarity of disclosure, and not by way of limitation, the detailed description of the invention is divided into the subsections set forth below.

Self-limiting Vacuum Nozzle

A self-limiting vacuum (SLV) nozzle (also referred to herein as an "SLV nozzle assembly" or a "nozzle assembly") is provided in which the vacuum can be unloaded at the nozzle to control the amount of material entering the suction tube, vacuum hose and collection tank. The strength of the vacuum, also referred to as lift or suction force, is typically measured in inches of mercury (in. Hg) or inches of water (in. $H_2O$), will impact the weight of the particles ingested by the vacuum system. The other characteristic of the vacuum system is the air flow rate, typically measured in cubic feet per minute (CFM), which will impact the amount of material that the vacuum system can transport through the vacuum hose to the collection tank. In one embodiment, the SLV nozzle can be used to ingest dry particulate matter, e.g., dust. In a preferred embodiment, the SLV nozzle can be used to remove combustible dust. FIGS. 1-11 show components and exemplary embodiments of the SLV nozzle described herein.

A method for removing dry particulate or finely divided matter, powder, or dust is also provided.

Any dry particulate or finely divided matter, powder, or dust can be removed using the SLV nozzle and the methods disclosed herein.

In one embodiment, the SLV nozzle is used to remove combustible dust. Any combustible dust known in the art can be removed using the SLV nozzle, including, but not limited to, coal dust, grain, flour or milling dust, confectioner sugar dust, resin or polymer dust (e.g., phenol formaldehyde resin dust, polyethylene dust) and combustible metals such as alkali metals, aluminum, magnesium, niobium, tantalum, titanium, and zirconium (see NFPA® 484: Standard for Combustible Metals, 2009 edition, NFPA, Quincy, Mass.).

Any "material that will burn in air" in a solid form can be explosive when in a finely divided form and can be removed using the SLV nozzle according to the methods disclosed herein.

Uses for the SLV nozzle and methods include, but are not limited to, removing explosive dusts in industrial settings, e.g., foundries (e.g., resin or metal dust), pharmaceutical plants (e.g., polymer dust), manufacturing plants (e.g., insulation dust), metal finishing and metal scalping operations, vehicle (e.g., automobiles) or vehicle parts plants (e.g., metal dust) (see U.S. Department of Labor, Occupational Safety and Health Administration, Directorate of Standards and Guidance, Office of Safety Systems, "Combustible Dust in Industry: Preventing and Mitigating the Effects of Fire and Explosions", Safety and Health Information Bulletin, SHIB Jul. 31, 2005.

The SLV nozzle body coupled to a hose may be used to regulate air flow and lift into the hose and industrial vacuum system. It is an objective of the embodiments to regulate the air flow rate and lift through the ports of the SLV nozzle to limit the rate at which explosive dusts are collected and to maintain the concentration of the explosive dust within the hose system below the Minimum Explosive Concentration (MEC) of the particular material collected by the SLV nozzle.

As used herein the term "hose" is used to designate any flexible or inflexible hose, tube, pipe or conduit known in the art for conducting air or fluid. The hose is preferably static conductive to reduce the danger of static buildup and bonded to a ground to dissipate any electrostatic charge. The nozzle is preferably made of a spark-resistant material such as stainless steel, aluminum, or copper. Other materials could be used that are static conductive, such as a modified static conductive PVC piping that includes an internal ground bar for conducting any build-up of static electricity caused by the flow of air through the PVC tubing.

Figure 1:
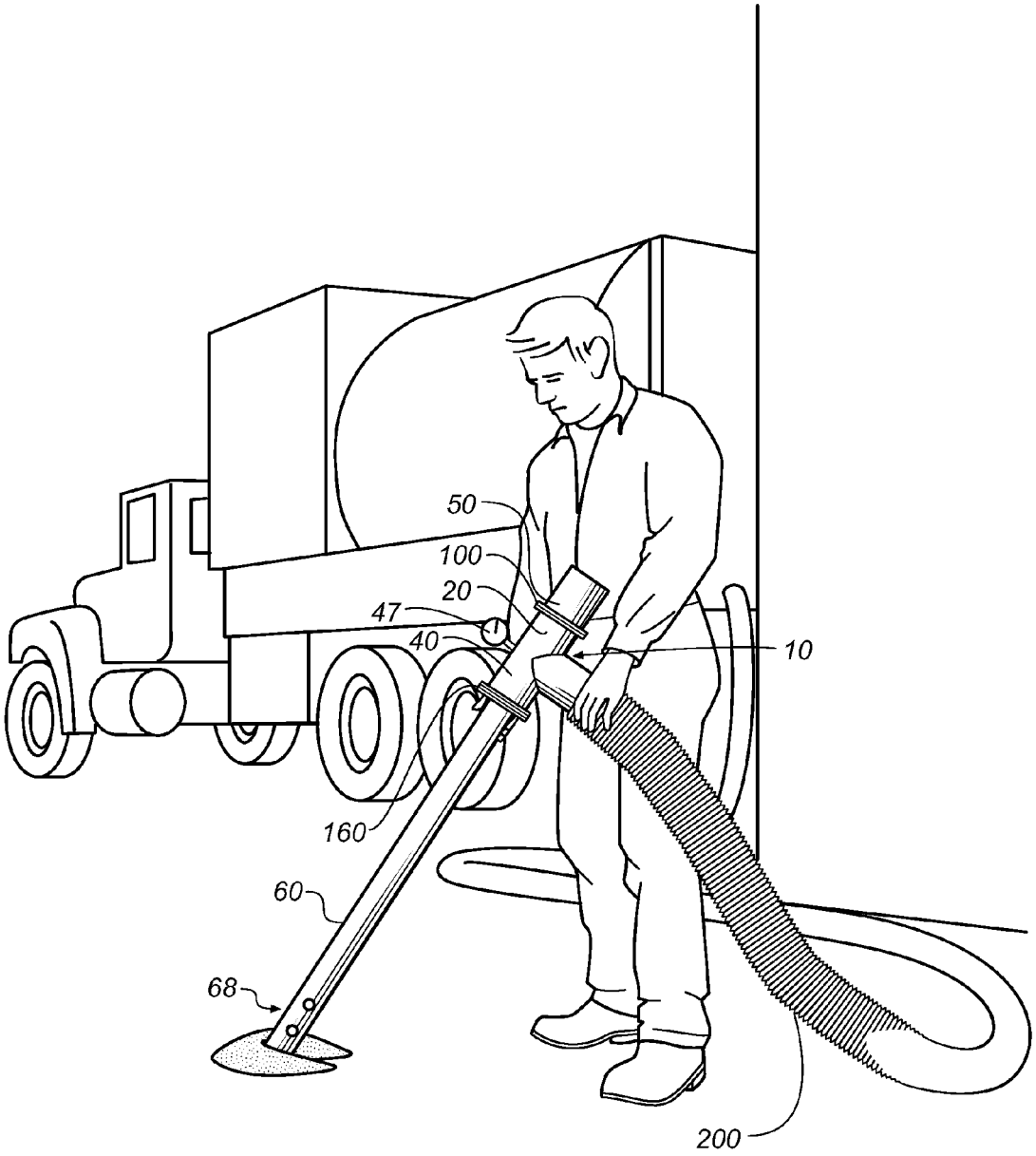
Figure 2:
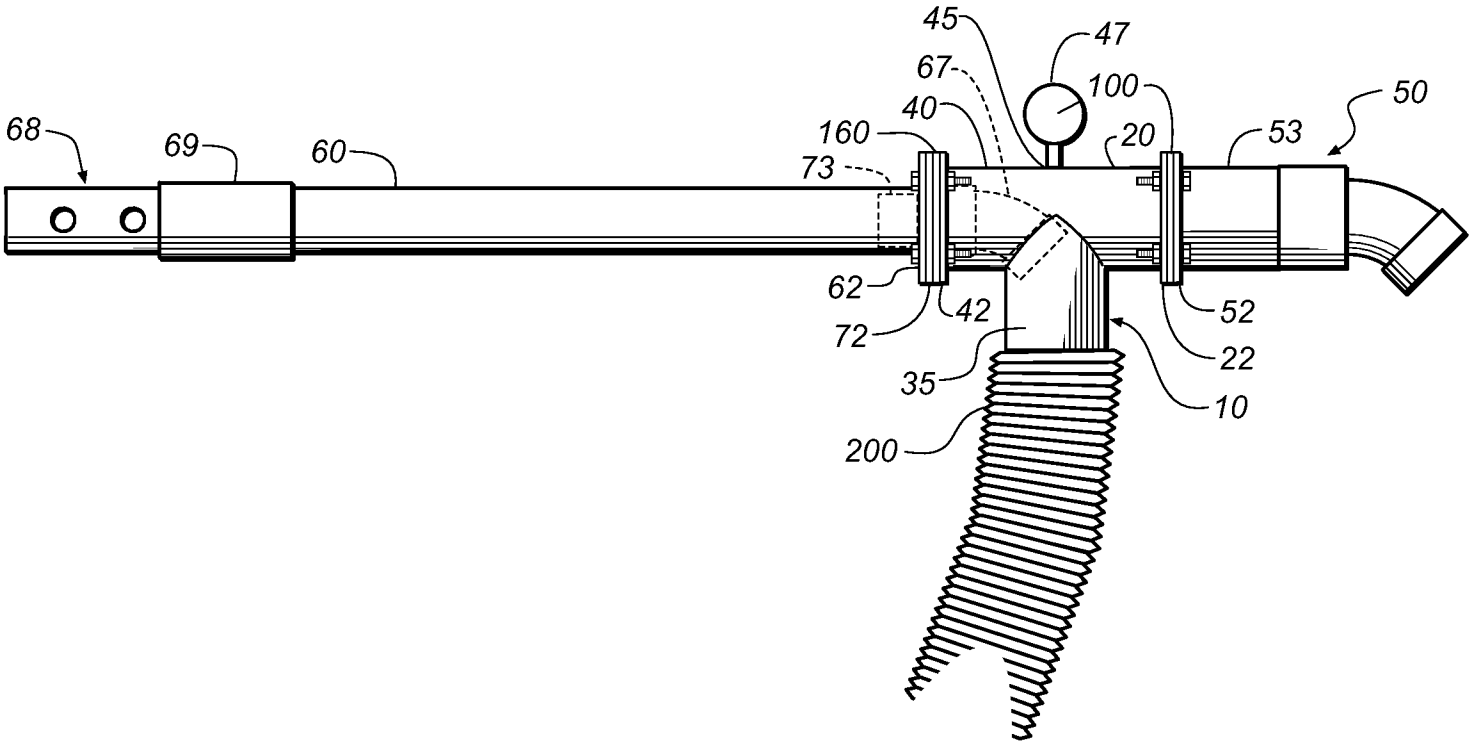
Figure 3:
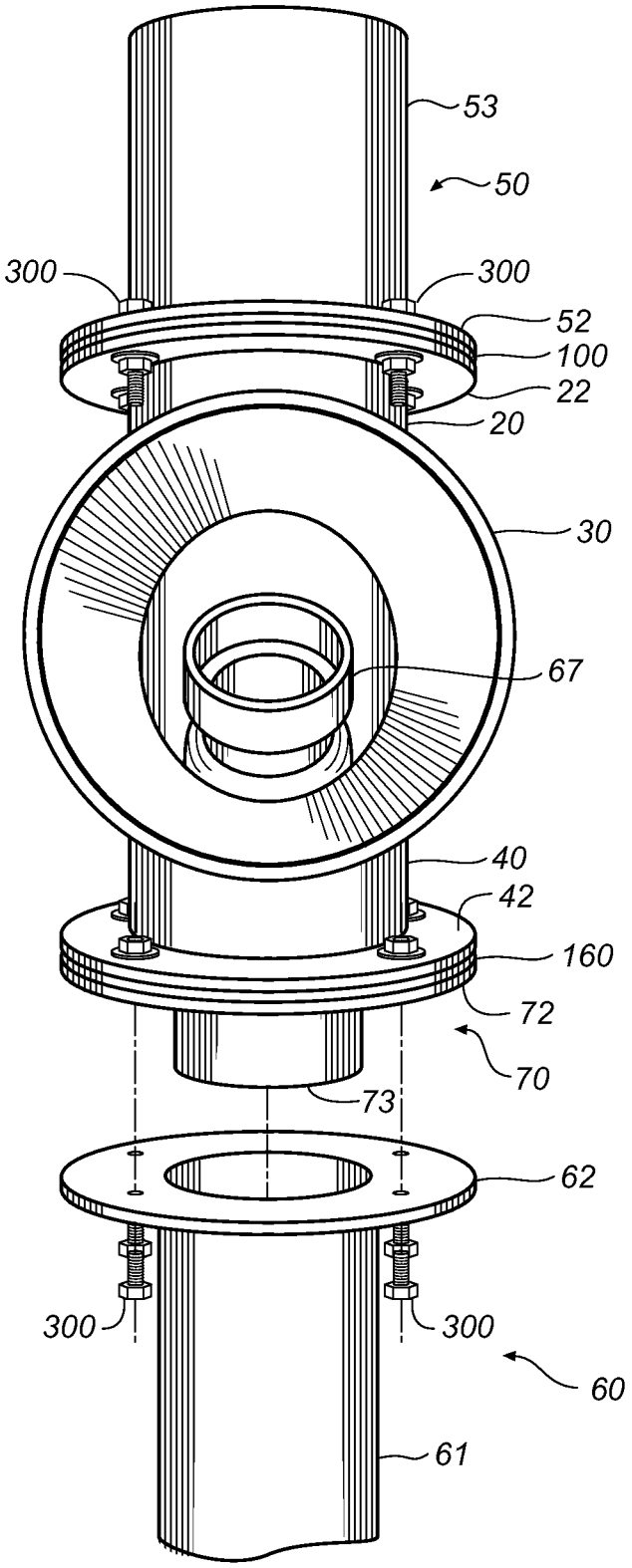
Figure 4:
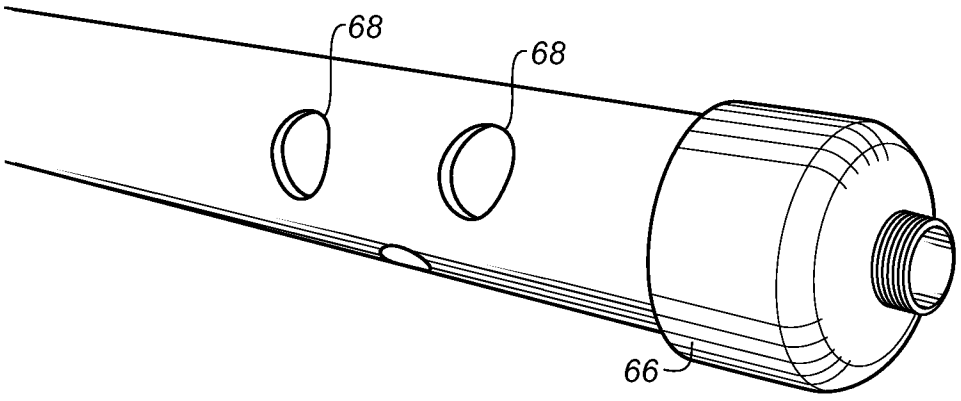
FIG. 4 shows flow reducer (also referred to herein as a "flow reducing tip") 66 that can be installed, if desired, on the distal end of the suction tube assembly 60 for very light materials with very low Minimum Explosion Concentration (MEC) to assist in achieving desired flow rate through the nozzle.
Figure 5:
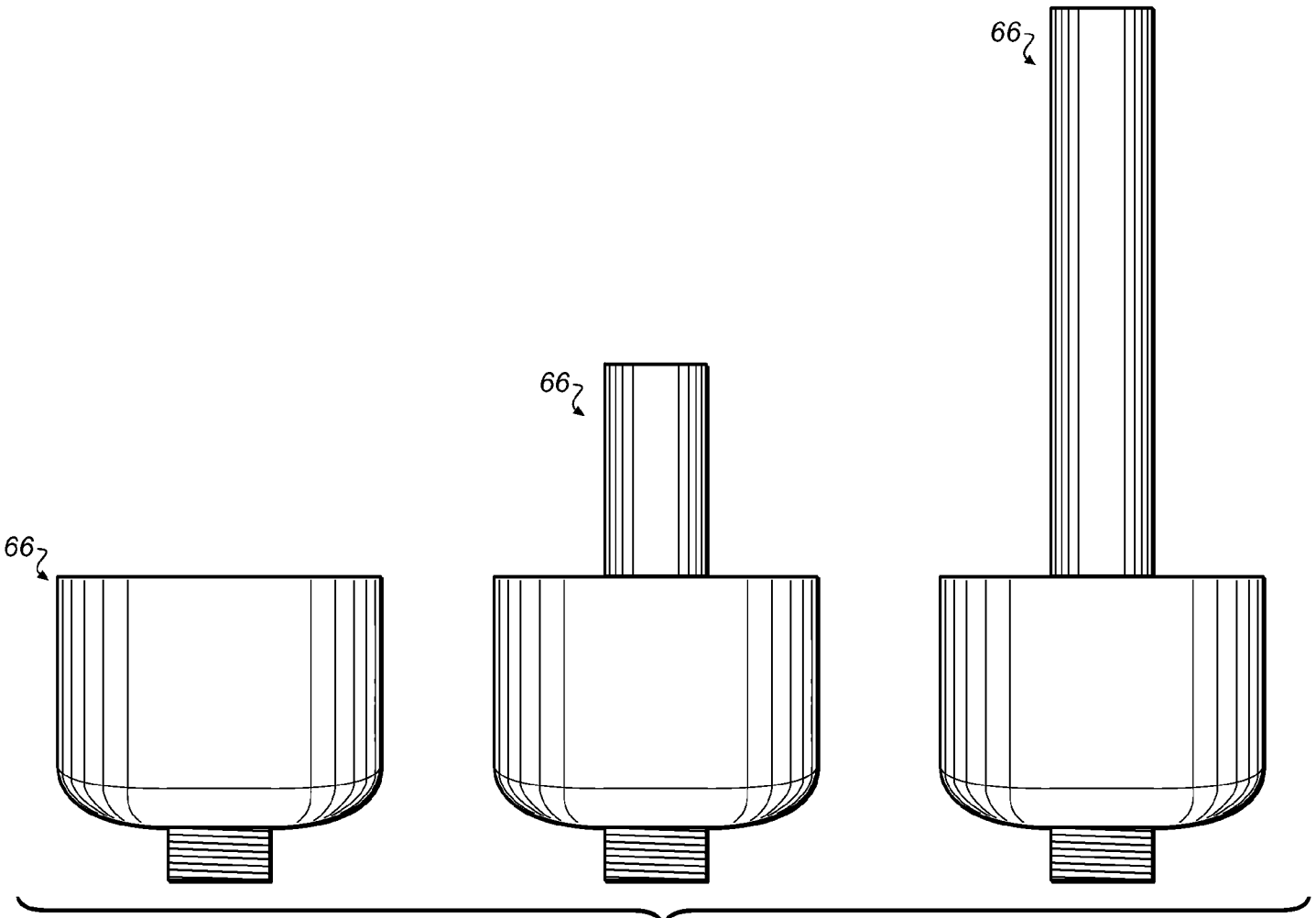
FIG. 5 shows three flow reducers 66 with the same inner diameter (I.D.) and varying suction tube lengths. The dimensions of the flow reducer inlet can vary with the density of the material to be removed and the flow rate.

FIGS. 1 and 2 show embodiments of the SLV nozzle 10. In one embodiment, the SLV nozzle comprises a SLV nozzle body 10 that can be tubular (or another suitable shape known in the art). The body can comprise any non-sparking metal or static conductive non-metal known in the art. In one embodiment, the body 10 is preferably T-shaped, with at least three, and in some embodiments, four inlet and/or outlet ports 20, 30, 40 and 45 that are preferably tubular and/or have a circular cross section (FIGS. 8-9).

At suction port 30, a hose or tube 200 can be connected, at a connection section 35 of the suction port, using any method known in the art, thereby connecting the SLV nozzle body to a vacuum system or source that is downstream from port 30.

In one embodiment, the vacuum hose can comprise a conductive element and a conductive element can be bonded or connected to ground.

Any vacuum system or source known in the art can be used. The source can be fixed into place with built-in ducting, or placed on a skid, cart or other vehicle. However, when used to collect combustible dust from the interior of a building, the vacuum source should be kept outside the building and a safe distance from other combustible materials. In a preferred embodiment, the vacuum source can be provided by a commercially available truck mount system.

Port 20 (also referred to herein as the SLV nozzle unloader port), is the port at which the unloader is installed. One or more SLV nozzle unloader discs 100 with varying opening sizes can be inserted into the SLV body 10 at port 20 to regulate the unloading of the vacuum. The SLV nozzle unloader disc (e.g., a washer or gasket) can be used to bypass, unload or reduce the strength of the vacuum and thereby adjust or reduce the ingestion of dust. The SLV nozzle unloader disc is preferably circular, although other suitable shapes known in the art can be used, i.e., to fit embodiments of the SLV nozzle with non-circular ports).

The SLV nozzle unloader disc 100 can have at least one opening area that can vary from e.g., from about 1% to about 99% (±0.5%), or from about 5% to about 95% (±0.5%) of the total cross section of the internal opening of the unloader portion of the SLV nozzle. When the vacuum source is activated and air is pulled through the SLV nozzle, adjusting the size of the opening of the SVL nozzle unloader disc and/or suction disc, the vacuum can be unloaded or metered down to decrease the strength (pull) of the vacuum. While the strength of the vacuum or suction force, measured in inches of mercury or water, provides the power to lift the particles, a sufficient airflow must be provided to carry the particle to the vacuum source. The size of the opening in the SLV nozzle unloader disc can be selected to provide a various desired vacuum strength given the known performance of the vacuum source and the hosing configuration using methods known in the art. In other embodiments, the unloader disc or the suction disc (see below) can comprise a plurality of perforations or openings that define holes.

FIG. 7 illustrates four embodiments of SLV nozzle suction discs 160 (or unloader discs 100; in certain embodiments, they can be used interchangeably) with variable openings that can range, for example from 10%-70% of the total area of the cross-section of the suction and unloader sections of the SLV nozzle. In various embodiments, the openings can be, for example, 10%, 15%, 20%, 25%, 30%, 35%, 40%, 45%, 50%, 55%, 60%, 65%, 70%, 75% 80%, 85%, 90% or 95% of the total cross-sectional area of the inlet port 40 or unloader port 20 of the SLV nozzle.

In certain embodiments, either face of a disc can face the interior of the SLV nozzle. Through holes in the disc 161 (FIG. 7) can be used for aligning and/or fastening to corresponding areas in flanges on the ports. Any suitable fastener (e.g., screw) can be used.

In another embodiment, a screen or cage, e.g., a convex mesh cage can be placed over the unloader port 20 after the SLV nozzle unloader disc is inserted into port 20. This screen or cage can be used to protect against the inadvertent blocking or clogging of the port at the back of the SLV nozzle, for example, by loose clothing of the operator.

In another embodiment of the SLV nozzle body (FIG. 15), at port 45, a source of inert gas or water can be connected. By reducing the oxygen content of the air flowing through the system, the risk of combustion within the hose 200 may be further reduced. Port 45 can be connected to a source that directs (or pumps) inert gas or exhaust gases, e.g., from the truck supplying the vacuum source (or from another other vehicle). Such addition of inert or exhaust gases or water can be used to further reduce the risk of an explosion during collection or removal of combustible dust. Additionally, some materials, such as coal or grain dust, may be wetted by the introduction of atomized water at port 45 to reduce incidence of fine particles in the air during collection.

The SLV nozzle is preferably pre-set to a specific configuration for the conditions of the site and/or not adjustable during use by the operator. An operator might become frustrated at the rate the SLV nozzle is collecting dust and otherwise decrease the offloading of vacuum to increase the ingestion of dust and allow the conditions in the hose system to exceed the MEC. Thus, in one embodiment, a cover or screen, preferably a telescoping cover or screen may be positioned over the unloader port. The cover or screen can be secured so that it cannot be removed or adjusted by the operator. This will prevent the user from inadvertently adjusting the draw or pull of the vacuum to exceed the MEC of the ingested material. The unloader port and unloader disc portion of the SLV nozzle is preferably adjusted by an experienced technician and then "locked down" so that the unloader disc cannot be altered, adjusted, removed or exchanged by the operator. While the size of the aperture in the embodiments of the unloader discs 100 depicted in the figures are fixed, variable aperture mechanisms are known in the art that could be substituted for the fixed aperture discs.

At port 40, the inlet port of the SLV nozzle, a suction tube assembly 60 can be inserted (FIGS. 1, 2, 10 and 11). FIGS. 2, 10 and 11 show a suction tube assembly with a material deflector 67 (in this embodiment a deflector elbow) at the proximal end of the suction tube assembly. The material deflector directs the material being suctioned from the suction tube assembly into the suction port. In other embodiments, the material deflector could be, for example, e.g., a deflector plate or other suitable deflector known in the art.

FIGS. 1, 2, 10 and 11 show a plurality of suction tube unloader ports 68 at the distal end of the suction tube assembly. The suction tube unloader ports in this embodiment of the suction tube assembly are holes or openings that regulate or decrease the lift or strength of the vacuum at the distal (collection) end of the suction tube assembly. In certain embodiments, the suction tube assembly can comprise an external sleeve. The external sleeve 69 can be fitted to surround a portion of the suction tube assembly and can slide along the suction tube, partially or completely closing the unloader ports or holes 68 and regulating the strength of the suction.

In certain embodiments, one or more SLV nozzle suction discs 160 may be inserted between an insertion flange 42 on the inlet port 40 and a SLV nozzle suction tube assembly adapter 70. An SLV nozzle suction tube assembly 60 can be inserted into the adapter 70, which has a second insertion flange 72 that can be mated with the SLV nozzle suction disc 160.

The suction tube assembly can be operably connected, at a connection section 73 of the adapter 70, using any method known in the art, thereby connecting the SLV nozzle to the SLV nozzle suction tube assembly 60. In certain embodiments, the unloader discs and suction discs are the same, interchangeable discs. In alternative embodiments, the unloader and/or suction discs may be fitted with variable aperture mechanisms that are preferably limited against adjustment by the operator in order to prevent an increase in the concentration of the combustible dusts above a certain percentage of the Minimum Explosive Concentration (MEC).

In another embodiment, a screen or cage is placed into or over inlet port 40 or over the distal end (furthest from the SLV nozzle) of the SLV nozzle suction tube assembly. This can be used to prevent carbon steel objects, such as stray hardware, fasteners or tooling, from entering the SLV nozzle and from being conducted to the vacuum system, where they could potentially cause sparks inside the hose system or collection tank for the combustible dust.

In another embodiment, a flow reducer (also referred to herein as a "flow reducing tip") 66 can be installed on the suction-tube assembly (if desired) for finely divided materials with a very low Minimum Explosion Concentration (MEC) to assist in achieving desired flow rate through the nozzle. See FIGS. 4-5. The length of the flow reducer can be used to control the rate of material entering the nozzle and hose system. The flow reducer can comprise a cap and a conduit extending through the cap.

In another embodiment, the SLV nozzle comprises a vacuum gauge 47 that is introduced into the air flow for measuring vacuum in the SLV nozzle. In a specific embodiment, the gauge can be inserted in a separate port (see FIG. 2, port 45).

In another embodiment, a source of inert gas, exhaust gases, air or water can be added to the air flow in the SLV nozzle reduce the concentration of material collected and/or the ambient oxygen level, which lowers the MEC. In another embodiment, the SLV nozzle comprises a port 45 for connecting the SLV nozzle to the source of inert gas, exhaust gases, air, or water applied through wet rings that are well known in the art.

In another embodiment, a grounding wire can be connected to the SLV nozzle and/or the collection hose to remove static electricity and reduce the chance of sparking. The conductive materials of the hose are bonded to the vacuum system which in turn is grounded to earth or a building ground.

In another embodiment, the SLV nozzle can comprise nozzle-mounted grounding bars and lugs for static conductive or dissipating grounding systems. Static grounding systems are typically field-installed systems including hose, nozzle leads, and fittings.

System for Removing Combustible Dust

In one embodiment, the SLV nozzle is used as a component in a combustible dust removal system. A guiding principle in removing combustible dust is that safe handling of the dust requires that the dust concentration in the air in the vacuum hose remain below the Minimum Explosive Concentration (MEC). MEC's for various combustible dusts are well known in the art. The NFPA Standard for Combustible Metals (2009 Edition) sets forth for acceptable or safe combustible metal concentrations. Preferably, several representative samples of the dust to be collected from various locations with a job site should be taken and analyzed to determine the content and particle size distribution of the various components contained in the dust as such factors have an impact on the MEC and desired ingestion rate of the dust.

In one embodiment, the air flow provided by the vacuum source (e.g., a vacuum truck) is essentially constant, but the volume of the dust entering the vacuum nozzle inlet can vary widely. For example, the quantity of dust entering the vacuum hose may be low when a broom-cleaned surface is vacuumed, but may spike sharply if a pocket or pile of dust inaccessible by broom is encountered. Safety equipment known in the art and commercially can be used to help minimize the risk available, e.g., conductive hoses specifically designed to convey combustible material, special tooling, etc. in accordance with NFPA 484 (NFPA, Quincy, Mass.). However, hazardous conditions can still occur in hoses or in the truck or other housing for the filtration system. For example, a spark can be generated if a carbon steel nut and bolt are vacuumed into the system and spark against each other on the truck tank. A spark can be generated from one sparking source, e.g., the carbon steel nut/bolt/tool impacting the steel collection tank wall at sufficient velocity to cause a spark. It is therefore preferable to use non-sparking linings or panels to further reduce the risk of sparing. Alternatively, the collection tank may be formed of or lined with stainless steel.

With bulk combustible dust in a vacuum collection tank, maintenance of the dust concentration in the air in the tank below the MEC is uncertain. Although vacuuming is generally necessary for a facilities housekeeping goals, the risks of dust concentrations above the MEC and spark generation by foreign objects entering the vacuum system are difficult to eliminate unless engineering controls beyond those standards in the art (e.g., NFPA Codes 77 and 484, NFPA, Quincy, Mass.).

Common high flow rate vacuum systems known and used in the art will have vacuum values of 12-27 in. Hg. To remove an industrial and/or combustible dust, the vacuum source (e.g., pump) will typically operate to draw at 4500 cu ft/min with a lift of 18 in. Hg. The rated performance of such high flow rate vacuum systems would typically ingest dusts at rates that far exceed the MEC of a combustible dust and other fines. Common truck mounted systems typically draw between 10-15 in Hg. There is a risk that this vacuum value will increase the combustible dust collected in the collection path above the MEC. In alternative embodiments, the industrial vacuum system may be operated at less than full rates to further regulate and restrict the rate at which the explosive dusts will be collected by the SLV nozzle. Manufacturers of industrial vacuum systems typically rate and provide system characteristics and blower performance curves that will be helpful in determining the desired aperture size to offload vacuum and control the rate of collection of the explosive dust. Such blower performance curves typically chart static pressure, airflow, horsepower, and/or blower efficiency and such relationships are well known in the art.

The self-limiting nozzle can be used, by itself or in conjunction with other engineering controls known in the art, to maintain the vacuum hose system in a non-explosive condition. For example, mass airflow sensors may be mounted in the collection hose to measure the air flow and concentration of the air-particle mixture. Signals from the sensor could be routed to a controller that adjusts the size of the aperture in a variable aperture mechanism at one or both of the suction and unloader discs within the SLV nozzle. The variable aperture mechanisms would be automatically adjusted to maintain the concentration of the explosive dust at or below the desired level.

In a specific embodiment, the vacuum system will almost always be grounded. Preferably, both the hose and the self-limiting nozzle are grounded using methods known in the art, e.g., through nozzle-mounted grounding lugs for static dissipating grounding systems. Static grounding systems are generally not commercially available, but are typically field-installed systems installed and tested on an ad hoc basis.

In another embodiment, the components of the vacuum system, e.g., the air tank, collection tank and/or hose(s), are composed of a spark-resistant material such as stainless steel, aluminum, copper or PVC.

It is also preferred that any collection tank used for the combustible dust (in the vacuum system or elsewhere in the collection pathway) be made of stainless steel or another non-sparking, high-strength material.

The vacuum source is preferably positioned outside of the building or area in which the combustible dust is to be collected. All collected dust is preferably discharged into a container located outside of the building. All equipment used is preferably fully compliant with NFPA Codes 77 and 651.

Known revolutions of the vacuum pump in the vacuum source can be used to calculate and to adjust the draw of the vacuum using methods known in the art.

Minimum Explosive Concentration (MEC)

The minimum explosive concentration (MEC) or dust concentration in the air can be determined and analyzed using methods well known in the art. For example, for aluminum dust, the calculation can be made using the following protocol:

1. Define and measure an area from which a dust sample will be collected (6"×6" for example).

2. Measure the thickness of the dust layer as carefully as possible and then collect all of the dust in the 6"×6" area with a scraper and seal in a container.

3. Weigh the dust sample. The weight divided by the volume (e.g., 6"×6"×the measured dust layer thickness) is the density of the dust.

4. Conduct a particle size analysis:

a. % less than 10 microns in diameter b. % less than 25 microns in diameter c. % less than 50 microns in diameter d. % greater than 100 microns in diameter e. Measure the % moisture 5. Measure the % aluminum. If the dust is less than 90-95% aluminum, additional test may need to be done (e.g., mass spectroscopy) to determine constituents of the dust.

6. Analyze for iron and iron oxides.

7. Collect samples from 4 or 5 areas at a minimum, and check for variability. If significantly different (greater than 15%) results are found in the samples, collect additional samples to assess overall variability.

Dust should be examined under a microscope to determine particle shapes. In particular, particles above 10 microns in diameter should be studied, as anything below that diameter will have a very high Kst (explosivity index), regardless of shape. The amount of irregular shaped particles present should be assessed, since irregular shapes generally have higher KST than spherical particles of the same size.

Vacuum Systems for Use with the Self-Limiting Nozzle

Any vacuum system known in the art for filtering air, cleaning air or removing combustible powders can be used with the SLV nozzle and system of the invention. In a preferred embodiment, the vacuum system comprises a vacuum source (e.g., vacuum pump). The vacuum source can be fixed into place with built-in ducting, or placed on a skid, cart or other vehicle. A typical truck-mounted vacuum system is manufactured and sold by Guzzler Manufacturing, Inc., of Streator, Ill., commonly referred to as a "Guzzler," and disclosed in "Guzzler" vacuum system overview and operation" (ACE_CL Operations_r7, Aug. 15, 2001, Guzzler Manufacturing Inc., 1621 South Illinois Street, Streator, Ill. 61364). In a truck mounted vacuum system, there are commonly four stages to the vacuum system. The first stage is a debris collection tank. The second stage is a cyclone filter chamber. The third stage is a filter baghouse. The fourth stage is a microstrainer. Such a vacuum system is designed to clean the air coming into the system by removing all dirt, dust and foreign matter from the air. The vacuum system's primary purpose is to protect the blower by removing all material from the air stream before it reaches the blower.

Method for Collecting and/or Removing Combustible Dust

A method for collecting and/or removing combustible dust is provided. In one embodiment, the method can comprise collecting by vacuum the combustible dust using the SLV nozzle to regulate the MEC of the combustible dust that is collected into a hose system connected to a vacuum system. In one embodiment, wherein the truck mounted vacuum (described above) is used, combustible dust is collected by the SLV nozzle connected to a hose that is connected to the inlet port of the vacuum system. The combustible dust, mixed with air, first enters the vacuum system through an inlet port at a concentration that is regulated by the SLV nozzle to be at a concentration that is calculated (using common practices known in the art) to be below the MEC for that dust and that will remain below the MEC as the combustible dust progressed through the vacuum system. In one embodiment, a deflector plate is introduced into the air stream to knock the bulk of the material out of the air stream and it falls to the floor of a collecting tank or debris tank. The deflector plate can be located, for example, inside the rear and at the top of the air tank. In the tank, the air travels through it to the other end. The air can then flow into a cyclone (centrifugal force) filter chamber. In the filter chamber, centrifugal force hurls the denser particles toward the cyclone walls where they spiral downward into the collection hopper. The lighter and by now relatively particle-free air that has traveled to the bottom of the cyclone, returns to the top.

The air stream leaves the cyclone chamber and enters a filter bag house. The air stream enters through the top and travels to the bottom of the bag house. The air returns to the top of the bag house through a series of filter bags. While the loader is in operation, short bursts of compressed air are directed from the air cannon through the filter bags dislodging the dust into a bag house collection hopper. The now clean air flows into a microstrainer housing from the filter bag house through the stand pipe plenum. The microstrainer housing contains a metal basket. It is the safety dropout point for any objects that may accidentally enter the vacuum system during servicing. Finally, the air passes through a vacuum pump and out through a silencer.

6. EXAMPLES

6.1 Example 1

Components of the Self-Limiting Vacuum (SLV) Nozzle

In various embodiments, the SLV nozzle can comprise:

SLV Nozzle 10 Components:

A. SLV body 11 (also referred to herein as a nozzle body) (FIGS. 1, 2, 6, 8 and 9)

B. Suction disc(s) 160 (FIGS, 6-7)

C. Unloader disc(s) 100 (can be used interchangeably with suction disc(s)

D. Unloader 50 at unloader port 20 (FIGS. 1-3 and 6).

E. Suction tube assembly 60 (FIGS. 1-3, 6, 10, 11) with suction tube assembly unloader ports (holes) 68

F. Protective screen or cage over the unloader hood

Suction Tube Assembly 60 Components:

A. Suction tube 61

B. Suction tube flow reducer 66 (FIGS. 4-5) mounted on the distal (pick up) end of the suction tube assembly 60

C. Screen or cage to prevent collection of small metal parts such as screws, nuts, and pins.

6.2 Example 2

Dry Vacuuming Using the SLV Nozzle

This example demonstrates the use of the SLV nozzle disclosed herein for dry vacuuming to remove accumulations of combustible dust (e.g., aluminum dust) from facility surfaces. To safely convey the dust generated from scalping operations, NFPA® 484 requires that the vacuum hose be maintained safely below the minimum explosive concentration (MEC) of 0.04 oz/ft$^3$. Preferably, the MEC is determined from a Material Safety Data Sheet (MSDS) for the material to be collected or other MEC reference known in the art.

As typically used, the vacuum source air flow is essentially constant, but the volume of dust entering the vacuum nozzle inlet can vary widely, depending on the conditions in the facility from which the combustible dust is to be removed. For example, the quantity of dust entering the vacuum hose may be low when vacuuming a broom cleaned surface, but may spike sharply if a pocket or pile of dust is encountered that was inaccessible by broom. While safety equipment specified NFPA 484 can help to minimize the risk, hazardous conditions can still occur in the hose system, if, for example carbon steel (hardware, nuts, bolts, tools) components are vacuumed into the system and collide with each other or the steel vacuum tank. A spark can be generated from one sparking surface (nut, bolt, tool) impacting the steel collection tank at sufficient velocity. With finely-divided combustible dust, "carry-over" from the debris tank, through the cyclone, and into the bag house is unavoidable for many vacuum source systems. Furthermore, maintenance of the dust concentration within these components while the blower is running is uncertain. This further underscores the importance of maintaining the dust concentration requirements described in NFPA 484 within the vacuum hose.

The first step of the cleaning method is the initial cleaning of all accessible surfaces using non-sparking brooms, hand brushes, pans scoops and accessories. Workers can be trained to conduct this work using methods to minimize generation of airborne dust NFPA 484 (2009), Paragraph 6.4.2.3.1.) Following initial cleaning using non-sparking brooms, hand brushes, pans, scoops and accessories to remove bulk dust, vacuuming will be used to remove dust accumulations to small, to dispersed, or inaccessible to be removed by hand brushing (NFPA 484 (2009), Paragraph 6.4.3.1). Vacuuming is preferably limited to surfaces that are first broom or brush cleaned. For those surfaces that are inaccessible by broom or brush, the SLV nozzle is used to maintain the vacuum hose, in a non-explosive condition as required by NFPA 484.

In one embodiment, a vacuum system is employed that comprises the SLV assembly, a 6" trunk line and 2-4" suction lines (6×4×4 system). At 12" hg, this 6×4×4 system will flow seven times higher (7×) than a standard commercial 4×2×2 model. At 15" hg, (80-100% load on most truck mount units) this system flows approximately six times (6×) greater than the industry standard 4×2×2 model. The 6×4×4 system can load over 67 pounds per hour while meeting the NFPA requirements governing vacuum hose minimum explosive concentrations (MEC). The 4×2×2 Novelis model, by contrast, with a flow rate in compliance with NFPA 484 will yield approximately 10-11 pounds of "fines" per hour.

The restrictive hose diameters typically specified for vacuum source systems (typically 350 H.P., 5000 CFM, 15" hg), the actual yield (load rate) on the 4×2×2 model will be even less due to the enormous frictional losses associated with 2" diameter hose. The 6×4×4 system flows at 7 times (7×) faster and performs significantly than the currently available 4×2×2 model.

During the vacuuming process, the vacuum truck is positioned outside of the building (NFPA 484 (2009), Paragraph A.6.1.1 0.1). All collected dust is then discharged as directed outside of the building.

Listing of Numbered Elements

10 Self-limiting vacuum (SLV) nozzle
11 SLV nozzle body
20 SLV nozzle port for installing unloader ("unloader port")
22 Flange for connecting (or mating) port 20 to unloader 50.
30 Port ("suction port") from SLV nozzle 10 to vacuum system or vacuum source
35 Connection section of port 30 from SLV nozzle 10 to vacuum system or vacuum source
37 Flange or hose stop on connection section 35 for connecting hose to SLV nozzle 10
40 Inlet port on SLV nozzle connecting to suction tube assembly 60
42 Insertion flange on port 40 for suction disc 160
45 Auxiliary or optional inlet port for e.g., vacuum gauge, inert gas or water
47 Vacuum gauge
50 Unloader in straight or 90 degree elbow configurations
52 Flange for connecting (or mating) unloader 50 to SLV nozzle port for installing unloader
53 Unloader body
54 Unloader distal opening
60 Suction tube assembly
61 Body of suction tube assembly 60
62 Insertion flange for connecting suction tube assembly 60 to adapter 70
63 Handle for directing position of suction tube assembly 60
64 Exemplary angle for angled tip of suction tube assembly 60
66 Flow reducer for suction tube assembly 60
67 Material deflector or deflection elbow for suction tube assembly 60
68 Suction tube assembly unloader port
69 Optional sleeve for suction tube assembly unloader port to regulate strength of suction in suction tube assembly 60
70 Adapter between SLV nozzle 10 and suction tube assembly 60
72 Insertion flange for inserting suction tube assembly onto adapter 70
73 Connection section of adapter 70
100 SLV nozzle unloader disc
101 Through holes in unloader disc for aligning and/or fastening to corresponding areas in flange 22 and/or 52
160 SLV nozzle suction disc
161 Through holes in suction disc for aligning and/or fastening to corresponding areas in flange 42 and/or 72. Any suitable fastener 300 (e.g., screw) can be used.
200 Hose
300 Fastener The present invention is not to be limited in scope by the specific embodiments described herein. Indeed, various modifications of the invention in addition to those described herein will become apparent to those skilled in the art from the foregoing description.

All references cited herein are incorporated herein by reference in their entirety and for all purposes to the same extent as if each individual publication, patent or patent application was specifically and individually indicated to be incorporated by reference in its entirety for all purposes.

The citation of any publication is for its disclosure prior to the filing date and should not be construed as an admission that the present invention is not entitled to antedate such publication by virtue of prior invention.

What is claimed is:

1. A self-limiting vacuum (SLV) nozzle for controlling the rate at which combustible dust is ingested into a vacuum system comprising:

a nozzle body comprising
an inlet port,
a nozzle body unloader port having a first internal cross-sectional area, and
a suction port adapted for coupling to a vacuum hose;

a suction tube assembly having a proximal end operably connected to the inlet port, and a distal end having a suction tube assembly unloader port;

an unloader disc adjacent to the nozzle body unloader port, said unloader disc defining at least one opening of selectable size to provide a desired vacuum strength, said opening having a second cross-sectional area less than the first cross-sectional area of the unloader port; and a material deflector for directing vacuumed material from the suction tube assembly into the suction;

wherein the at least one opening in the unloader disc is sized to control the rate at which the combustible dust is ingested by a vacuum system and sized to maintain the concentration of combustible dust within the vacuum hose at a level below the minimum explosive concentration (MEC) of the combustible dust.

2. The SLV nozzle of claim 1 wherein the suction tube assembly comprises a positionable sleeve operatively coupled to the sleeve assembly to selectively cover at least one of the suction tube assembly unloader ports.

3. The SLV nozzle of claim 1 wherein the suction tube assembly further comprises a flow reducing tip comprising a cap and a conduit extending through said cap.

4. The SLV nozzle of claim 3, wherein the flow reducing tip has a length dimensioned to control rate of material entering the SLV nozzle.

5. The SLV nozzle of claim 1 further comprising a suction disc defining an opening, said suction disc positioned adjacent to the suction port.

6. The SLV nozzle of claim 1 further comprising a screen adjacent to the suction tube assembly that restricts the inadvertent ingestion of carbon steel hardware.

7. The SLV nozzle of claim 1 further comprising an auxiliary port for connection of a vacuum gauge.

8. The SLV nozzle of claim 1, wherein the at least one opening has from about 5% to about 95% (±0.5%) of the total cross section of the internal opening of the unloader port.

9. A vacuum system for removing combustible dust comprising:

a vacuum source;

a self-limiting nozzle operatively connected to the vacuum source by a vacuum hose, said self-limiting nozzle comprising a nozzle body comprising a nozzle inlet port, a nozzle unloader port, and a suction port coupled to the vacuum hose;

a suction tube assembly having a proximal end operably connected to the nozzle inlet port, and a distal end including a plurality of suction tube assembly unloader ports; and an unloader disc adjacent to the nozzle unloader port, said unloader disc defining at least one opening of selectable size to provide a desired vacuum strength, said opening having a second cross-sectional area less than the first cross-sectional area of the unloader port;

a material deflector for directing vacuumed material from the suction tube assembly into the suction port;

said nozzle body adapted to receive a nozzle unloader disc adjacent to the nozzle unloader port, said nozzle unloader disc defining at least one opening of a selectable size to provide a desired vacuum strength;

wherein the at least one opening in the unloader disc is sized to control the rate at which the combustible dust is ingested by the vacuum system and sized to maintain the concentration of combustible dust within the vacuum hose at a level below the minimum explosive concentration of the combustible dust, the at least one opening sized from about 1% to about 99% (±0.5%) of the total cross section of the internal opening of he unloader portion of the SLV nozzle.

10. The vacuum system of claim 9 wherein the suction tube assembly comprises a positionable sleeve operatively coupled to the sleeve assembly to selectively cover at least one of the suction tube assembly unloader ports.

11. The vacuum system of claim 9 wherein size of the opening in the unloader disc is selectable by inserting one of a plurality of unloader discs defining openings of differing cross-sectional areas.

12. The vacuum system of claim 9 wherein size of the opening in the unloader disc comprises a variable aperture mechanism.

13. The vacuum system of claim 9 wherein said vacuum hose comprises a conductive element that is bonded to ground.

14. The vacuum system of claim 9, wherein the at least one opening has from about 5% to about 95% (±0.5%) of the total cross section of the internal opening of the nozzle body unloader port.

15. A method for collecting combustible dust comprising the steps of:

determining the minimum explosive concentration of a combustible dust to be collected;

providing a self-limiting nozzle (SLV) comprising a nozzle body comprising a nozzle inlet port, a nozzle unloader port having a first internal cross-sectional area, a suction port, a suction tube assembly having a proximal end operably connected to the inlet port, and a distal end having a suction tube assembly unloader port, a nozzle unloader disc adjacent to the nozzle unloader port, said nozzle unloader disc defining at least one opening of a selectable size to provide a desired vacuum strength, said opening having a second cross-sectional area less than the first cross-sectional area of the unloader port, wherein the at least one opening in the unloader disc is sized to control the rate at which the combustible dust is ingested by a vacuum system and sized to maintain the concentration of combustible dust within a vacuum hose at a level below the minimum explosive concentration (MEC) of the combustible dust, and a material deflector for directing vacuumed material from the suction tube assembly into the suction port;

operatively connecting the self-limiting nozzle to a vacuum hose. said vacuum hose being operatively connected to a vacuum source having a known suction force and air flow rate;

determining a desired rate of ingestion of the combustible dust that maintains the concentration of the combustible dust within the vacuum hose at a level below the minimum explosive concentration of said dust;

selecting the size of the opening of the nozzle unloader disc, given the suction force and flow rate of the vacuum source, that limits the rate of ingestion of combustible dust to maintain the concentration of dust below the minimum explosive concentration of said dust; and collecting by vacuum combustible dust using the self-limiting nozzle.

16. The method of claim 15 further comprising the step of controlling the rate of ingestion of combustible dust through the suction port by inserting a suction disc adjacent to the suction port.

17. The method of claim 15 further comprising the step of controlling the rate of ingestion of combustible dust by providing suction tube assembly unloader ports in a distal end of the suction tube assembly.

18. The method of claim 15 further comprising the step of providing a vacuum hose that comprises a conductive element and bonding said conductive element to ground.

19. The method of claim 15 wherein the vacuum source is a truck-mounted high flow rate vacuum source.

* * * * *

UNITED STATES PATENT AND TRADEMARK OFFICE

CERTIFICATE OF CORRECTION

PATENT NO. : 9,089,882 B2
APPLICATION NO. : 13/485173
DATED : July 28, 2015
INVENTOR(S) : Gregory Boltus It is certified that error appears in the above-identified patent and that said Letters Patent is hereby corrected as shown below:

In the claims

Col. 14, Claim 1, Line 59, delete “into the suction” and replace with --into the suction port--;

Col. 15, Claim 9, Line 52, delete “he” and replace with --the--.

Signed and Sealed this
Fifteenth Day of December, 2015

Michelle K. Lee

Michelle K. Lee
*Director of the United States Patent and Trademark Office*